US005636975A

United States Patent [19]

Tiffany et al.

[11] Patent Number: 5,636,975

[45] Date of Patent: Jun. 10, 1997

[54] INLET AND DISCHARGE VALVE ARRANGEMENT FOR A HIGH PRESSURE PUMP

[75] Inventors: James C. Tiffany, Corpus Christi, Tex.; William K. Morgan, Arabi, La.

[73] Assignee: Reynolds Metals Company, Richmond, Va.

[21] Appl. No.: 222,746

[22] Filed: Apr. 4, 1994

[51] Int. Cl.[6] ..... F04B 53/10

[52] U.S. Cl. ..... 417/454; 417/539; 417/567; 417/571; 137/454.4; 137/512

[58] Field of Search ..... 417/454, 539, 417/567, 571; 137/454.4, 454.6, 512

[56] References Cited

U.S. PATENT DOCUMENTS

| | | | |
|---|---|---|---|
| 3,106,169 | 10/1963 | Prosser et al. . | |
| 3,260,217 | 7/1966 | Thresher | 417/567 |
| 3,309,013 | 3/1967 | Bauer | 417/571 |
| 3,309,014 | 3/1967 | Bauer et al. | 417/571 |
| 3,702,624 | 11/1972 | Fries . | |
| 3,709,638 | 1/1973 | Iguchi et al. . | |
| 4,602,740 | 7/1986 | Stachowiak . | |
| 4,616,983 | 10/1986 | Hanafi | 417/571 |
| 4,741,680 | 5/1988 | Bröker et al. . | |
| 4,858,828 | 8/1989 | Stachowiak . | |
| 4,878,815 | 11/1989 | Stachowiak . | |
| 5,037,276 | 8/1991 | Tremoulet, Jr. | 417/567 |
| 5,059,101 | 10/1991 | Valavaara . | |
| 5,064,354 | 11/1991 | Robertson et al. . | |
| 5,127,807 | 7/1992 | Eslinger | 417/539 |
| 5,165,451 | 11/1992 | Goldsmith . | |
| 5,171,136 | 12/1992 | Pacht . | |
| 5,230,363 | 7/1993 | Winn, Jr. et al. | 137/512.3 |

FOREIGN PATENT DOCUMENTS

| | | | |
|---|---|---|---|
| 1911534 | 10/1970 | Germany | 417/454 |
| 3003869 | 8/1981 | Germany | 417/571 |
| 392758 | 10/1965 | Switzerland | 417/571 |

OTHER PUBLICATIONS

"Fluid End Maintenance," 1 page from brochure issued by Jetstream of Houston, Inc., Houston Texas.

"Aldrich Vertical Plunger Pumps," pp. 4, 5, 8, and 9 of brochure (Form 79034), issued by Ingersoll–Rand Co., Woodcliff Lake, New Jersey.

"Fatigue of Metals and Structures," Department of the Navy, NAVAER 00–25–534, p. 25, 1954.

"Metallic Materials and Elements for Aerospace Vehicle Structures," MIL–HDBK–SE, Department of Defense, pp. 2–132, 1 Jun. 1987.

*Primary Examiner*—Timothy Thorpe
*Assistant Examiner*—Roland G. McAndrews, Jr.
*Attorney, Agent, or Firm*—Alan M. Biddison

[57] ABSTRACT

A high-pressure, plunger-type liquid pump including a liquid manifold that includes a plunger chamber in the form of an axial cylindrical bore portion for slidably receiving a pressurizing plunger, and that also includes a valve chamber coaxial with the plunger chamber and in communication therewith for removably receiving a cartridge-type flow control valve. The liquid manifold includes a closure plug to close the valve chamber. The cartridge-type valve is slidably received in the valve chamber for enabling removal of the cartridge-type valve from the liquid manifold without the need for separating the liquid manifold from the pump drive housing. The cartridge-type valve is of a structure that includes in-line, axially spaced suction and discharge valves that are each spring biased into closed positions. High-pressure liquid is confined within a valve housing body that contains the suction and discharge valves, to minimize damage to the liquid manifold as a result of pressure fluctuations and high-pressure flows. The cartridge-type valve is removable from the manifold without the necessity of removing or even separating the manifold from the pump drive housing.

51 Claims, 7 Drawing Sheets

INLET AND DISCHARGE VALVE ARRANGEMENT FOR A HIGH PRESSURE PUMP

BACKGROUND OF THE INVENTION

1. Field of the Invention

The present invention relates to high-pressure, plunger-type liquid pumps adapted for continuous operation at pressures at or above about 15,000 psi., and to an improved, long-life flow control valve for regulating the flow of liquid into and out of the plunger cylinder of a high-pressure, plunger-type liquid pump.

2. Description of the Related Art

Positive displacement, high-pressure liquid pumps have been in use for some time. However, it has been found that commercially available pumps fail rapidly when operated continuously at liquid pressures exceeding about 8,000 psi. and at flow rates of about 10 gpm. per plunger (47 hydraulic horsepower equivalent). In order to increase the relatively short operating time between failures for such liquid pumps the pressures and flow rates at which the pumps can be effectively operated must be limited, which thereby limits the number and types of applications for such pumps.

Investigation has revealed that failures of the preexisting high-pressure pumps and valves was often caused by a cross-port structural arrangement, wherein, when the high-pressure liquid underwent abrupt changes in flow direction and pressure, and transferred this pressure change to the pump housing the result was erosion and stress cracking of the metal at the port areas of the valve and pump housing or casing. Accordingly, the pumps and valves when operated at high pressures, especially pressures of over about 10,000 psi., would be required to be removed from service and repaired on a frequent basis, and consequently the use of the pumps at such high pressures resulted in very high maintenance costs per pump operating hour.

One form of pump and valve structure that was devised in an effort to improve the operating life of high-pressure pumps at high-pressure conditions is disclosed in U.S. Pat. No. 4,878,875, which issued on Nov. 7, 1989 to J. Edward Stachowiak. That patent identifies some of the earlier-issued patents that disclose the right angle, or cross-port bore arrangements in the prior art pumps, and it also identifies patents that have valve bores that are arranged coaxially with the pump plunger bore access.

The above-identified Stachowiak patent discloses a pump structure that includes a liquid manifold, or "fluid end," as it is referred to in the art, that receives a cartridge-type valve that is carried within the manifold and is positioned coaxially with the pump plunger axis. The valve is readily replaceable, but only upon separation of the liquid manifold from the pump housing. Additionally, the disclosed valve also seats on the outermost surface of a stuffing box that defines the pump plunger chamber. Removal of the cartridge valve requires removal of the manifold block from the pump drive housing. The manifold block is pivotally carried by a flange plate that is secured to the pump drive housing structure, and it surrounds a removable stuffing box that includes the pump plunger. Furthermore, the Stachowiak cartridge valve, although an improvement for high-pressure pumps having relatively low liquid output rates, cannot effectively be scaled up to higher liquid output rates of beyond about 50 hydraulic horsepower per cylinder because the valve structure includes a relatively large diameter discharge valve, which upon scaling up to higher output rates results in a larger valve cavity diameter that would be subjected to stresses that exceed the strength of the steel available for the manufacture of fluid ends for such pumps. Therefore, the Stachowiak valve and pump design, although an improvement over the previously-existing valve and pump designs, has limited applicability because of the limitations caused by the structural configuration of the cartridge valve.

It is an object of the present invention to overcome the shortcomings of the prior art pump and valve structures for use in high-pressure liquid pumps.

It is a further object of the present invention to provide a high-pressure pump design that is easily maintainable and that provides rapid accessibility to the flow control valves for servicing.

It is another object of the present invention to provide an improved high-pressure liquid pump structure in which the high-pressure plunger cylinder and the liquid distribution manifold are housed in a unitary structure, within which the flow control valve is also positioned.

It is a still further object of the present invention to provide a liquid manifold for a high-pressure liquid pump in which access to the liquid flow control valves can be had without removing the liquid manifold from the pump housing.

It is still another object of the present invention to provide a pre-assembled cartridge-type valve that can be readily installed and removed from the pumping cylinder of a high-pressure liquid pump for rapid servicing.

It is another object of the present invention to provide a pre-assembled cartridge type valve in which all moving parts are internal to the valve.

It is another object of the present invention to provide a pre-assembled cartridge type valve in which the outside of the valve housing contains the required drilling and plenum chambers leaving the bore(s) in the pump housing essentially free of abrupt diametrical changes which can be a source of stress concentration and failures.

It is still another object of the present invention to provide a pre-assembled cartridge type valve in which the principal stresses are contained within the cartridge, a replaceable and repairable item, and not transferred to the valve housing, a much larger and generally unrepairable item.

It is another object of the present invention to provide a high-pressure liquid flow control cartridge valve that has a relatively loose fit in a liquid manifold and that includes simple seals and requires no close tolerance, metal-to-metal contact.

SUMMARY OF THE INVENTION

Briefly stated, in accordance with one aspect of the present invention, a high-pressure liquid pump is provided that includes a reciprocating plunger for increasing the pressure of liquids to liquid pressures of the order of about 15,000 psi. and at flow rates of up to or above about 20 to 30 gpm. for each individual pump cylinder. The pump includes a pump drive housing including at least one plunger supported for reciprocating movement along a plunger movement axis, and a drive arrangement operatively connected with the plunger for converting continuous rotational input power into linear reciprocating movement of the plunger. A manifold is provided to at least partially enclose the plunger, wherein the manifold is adapted to be connected with the pump drive housing in liquid-tight relationship therewith. The manifold includes a pressure cylinder coaxial with the plunger movement axis for receiving and supporting the plunger as the plunger reciprocates within the cylinder in substantially liquid-tight engagement therewith to increase the pressure of a liquid contained within the cylinder. A chamber is provided that is coaxial with the pressure cylinder for receiving a cartridge valve to control liquid flow into and out of the pressure cylinder, the cartridge valve includes a suction valve for controlling flow of low-pressure liquid into the pressure cylinder, and a discharge valve for controlling the flow of high-pressure liquid from the pressure cylinder. The manifold includes a liquid inlet communicating with the suction valve for admitting into the cartridge valve the liquid to be pressurized, and a liquid outlet communicating with the discharge valve for conducting pressurized liquid to a point external to the manifold.

In accordance with another aspect of the present invention, a manifold for a high-pressure liquid pump adapted for increasing the pressure of a liquid to about 15,000 psi. is provided. The manifold is a unitary housing including a pressure chamber for slidably receiving a reciprocating plunger for pressurizing liquid contained within the pressure chamber. A flow control valve chamber is provided within the manifold and is coaxial and in communication with the pressure chamber. The control valve chamber has a cross-sectional area greater than that of the pressure chamber for receiving and supporting a flow control valve that includes in-line suction and discharge valves. The valve chamber extends to an opening in the manifold spaced from and opposite from the pressure chamber to permit the flow control valve housing to be removed from the manifold while the manifold is secured to a pump drive housing. A suction passageway extends transversely relative to the longitudinal axis of the valve chamber to provide communication between a low-pressure liquid inlet to the manifold and the suction valve. Additionally, a discharge passageway spaced axially from the suction passageway and extending transversely relative to the longitudinal axis of the valve chamber is provided to permit communication between the high-pressure liquid outlet to the manifold and the discharge valve.

In accordance with a further aspect of the present invention, a cartridge-type valve is provided for controlling the flow of low-pressure inlet liquid and of high-pressure outlet liquid to and from a high-pressure liquid pump. The valve includes a tubular valve housing having a longitudinal axis and a central longitudinal passageway for axially slidably receiving a suction valve body and a discharge valve body. The housing includes a suction inlet passageway extending transversely of the central passageway to a first point external to the housing, and a discharge outlet passageway extending transversely from the central passageway to a second point external to the housing, wherein the second point is axially spaced along the housing longitudinal axis from the first point. The valve housing includes a suction valve that is axially slidably carried within the valve housing and is adapted to selectively cover and uncover a liquid inlet passageway. A discharge valve is also axially slidably carried within the valve housing and is in opposed relationship with the inlet valve. The central passageway permits communication between the plunger, the suction valve and the discharge valve to selectively enable and to block flow to and from the discharge outlet.

DESCRIPTION OF THE PREFERRED EMBODIMENTS

Figure 1:
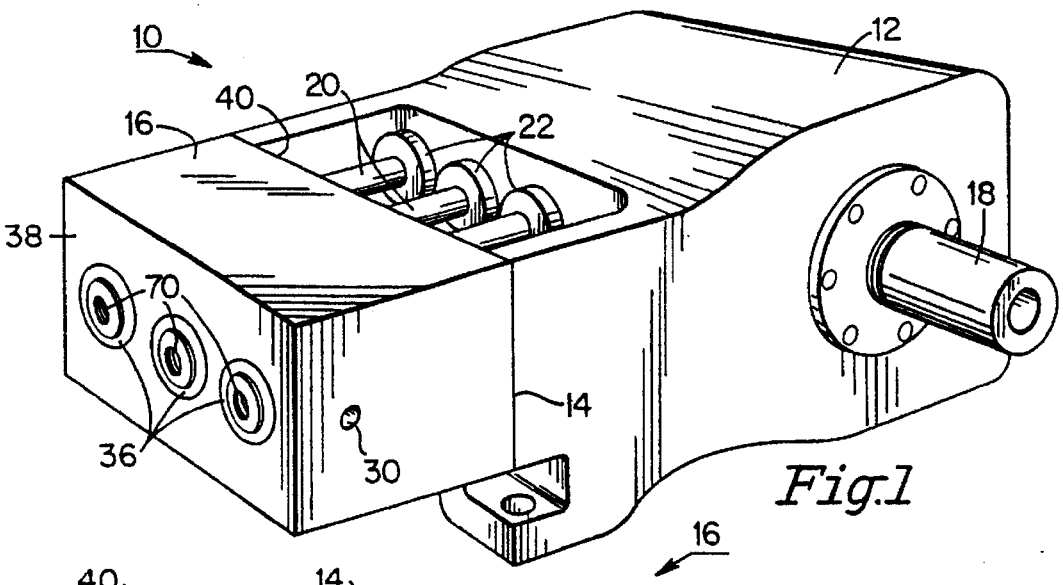
FIG. 1 is a perspective view of a high-pressure liquid pump that includes a liquid manifold and a high-pressure valve structure that form part of the present invention.

Referring now to the drawings, and particularly to FIG. 1 thereof, there is shown a horizontally-disposed, high-pressure liquid pump 10 for pressurizing liquids to pressures up to the order of about 15,000 psi. Pump 10 includes a pump drive housing 12 having a vertically disposed liquid manifold mounting surface 14. A liquid manifold 16 is securely bolted to pump drive housing 12 by a plurality of mounting bolts (not shown). Pump drive housing 12 receives input power that is delivered in rotary form from a suitable source of power to an input shaft 18 which, through a crankshaft and connecting rod arrangement of a type known to those having skill in the art and positioned within pump drive housing 12, converts the rotary input power to linear, reciprocating power that is imparted to the several pump plungers 20 that are axially slidably supported in respective plunger sleeves 22. The pump structure illustrated includes three pump plungers, although more or fewer such plungers can be provided, if desired.

Liquid manifold 16 is shown in FIGS. 1 through 4, and is in the form of a one-piece structure that includes a plurality of plunger cylinders 24 to slidably receive respective plungers 20 for reciprocating movement therewithin. Manifold 16 also carries within it and in communication with the plunger cylinders individual flow control valves, one for each plunger cylinder, for admitting low pressure liquid into the respective plunger cylinders and for permitting the flow from the plunger cylinders of high pressure liquid after the pressure of the liquid has been significantly increased, to the order of about 10,000 to about 15,000 psi. Liquid is introduced into manifold 16 through a plurality of suction inlets 28, one for each plunger cylinder, that are positioned on lowermost surface 26 (see FIGS. 3 and 4). A liquid outlet 30 is provided at each of lateral end surfaces 32 and 34 of manifold 16 to carry away the pressurized liquid for subsequent use. A plurality of closure plugs 36, the structure of which will be hereinafter described, are received in respective bores that extend inwardly from the front surface 38 of manifold 16.

Figure 2:
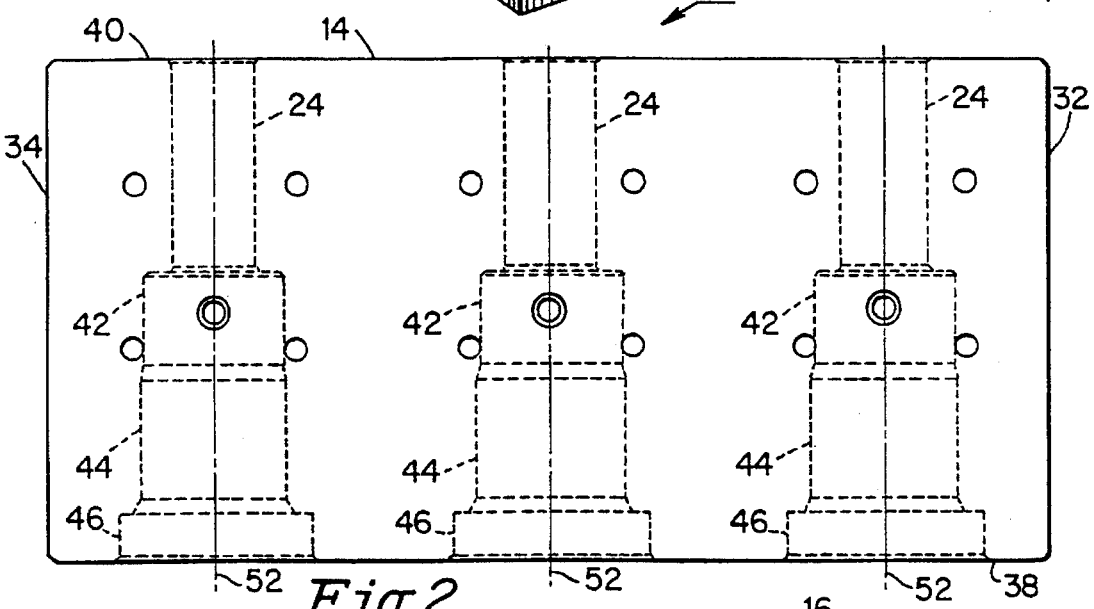
FIG. 2 is a bottom view of the liquid manifold structure shown in FIG. 1.
Figure 4:
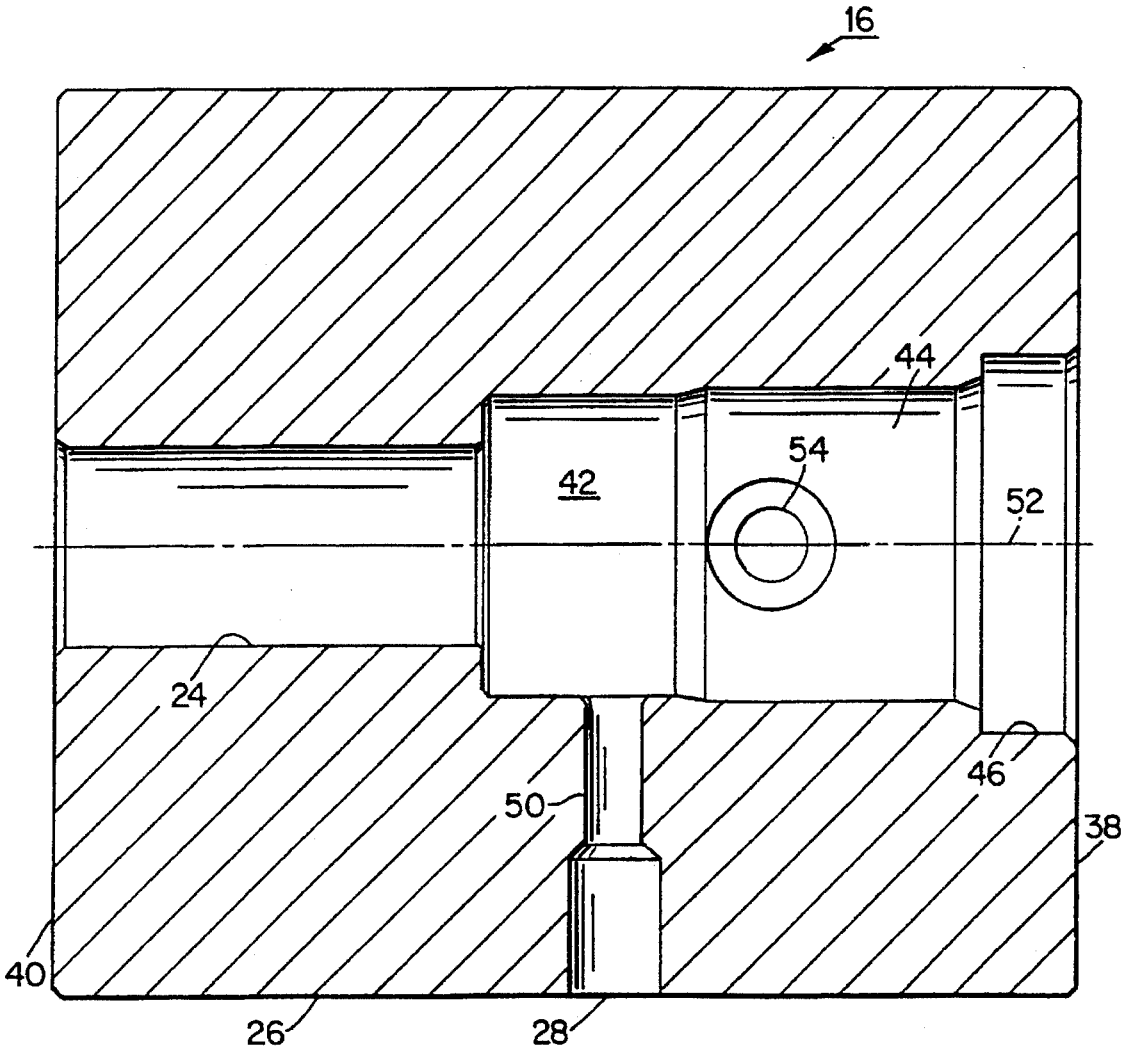
FIG. 4 is a cross-sectional view of the liquid manifold taken along the line 4—4 of FIG. 3.

Referring now to FIGS. 2 and 4, liquid manifold 16 includes three laterally spaced plunger cylinders 24 that have their respective longitudinal axes parallel with each other and that extend inwardly from manifold rear surface 40. Plungers 20 extend outwardly of pump drive housing 12 at manifold mounting surface 14, to which manifold rear surface 40 is securely mounted in contacting, liquid-tight relationship. Within manifold 16 and in axial alignment with and in communication with plunger cylinders 24 are respective cartridge valve chambers 42 and a portion of 44 for containing respective cartridge-type valves having a structure to be hereinafter described. Extending inwardly from manifold front surface 38 and axially aligned with and in communication with cartridge valve chambers 42 and a portion of 44 are respective closure plug chambers occupying the remaining portion of 44 for removably receiving a suitable closure plug 36 (see FIGS. 1 and 4). Each of plunger cylinder 24, cartridge valve chamber 42, and cartridge valve and closure plug chamber 44 are in coaxial alignment with each other and are of circular cross section.

Figure 3:
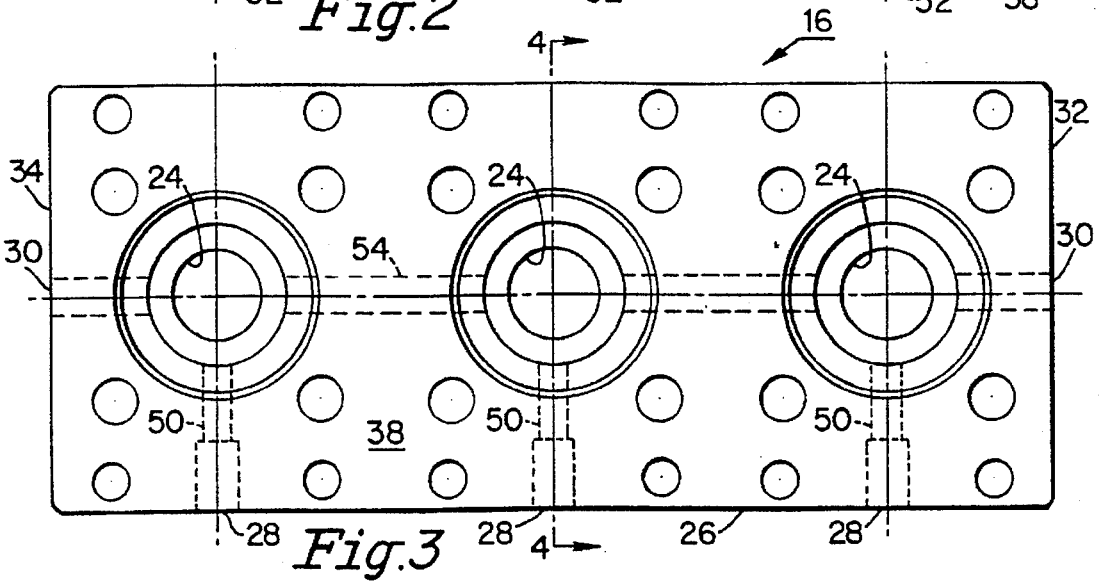
FIG. 3 is an end elevational view of the liquid manifold structure shown in FIG. 1.

Plunger cylinders 24 each have an inner diameter that is slightly larger, for instance ⅛", than the outer diameter of plungers 20. The diametrical clearance can be greater or less and the pump will still work. Cartridge valve chambers 42 each have a larger diameter than that of corresponding plunger cylinders 24, and that diameter is defined by a counterbore that extends outwardly toward manifold front surface 38 and terminates in an enlarged counterbore 46 to receive the outermost end flange 48 of closure plug 36. Additionally, as best seen in FIGS. 3 and 4, each cartridge valve chamber 42 and 44 is in communication with a suction passageway 50 that extends inwardly from and communicates with a respective suction inlet 28 for admitting low-pressure liquid from a low-pressure liquid source (not shown) into cartridge valve chamber 42 and subsequently through the valve and into plunger cylinder 24. As shown in FIG. 4, suction inlet 28 and suction passageway 50 are axially spaced along valve chamber axis 52 from and offset by 90° from the axis of discharge passageway 54.

Figure 5:
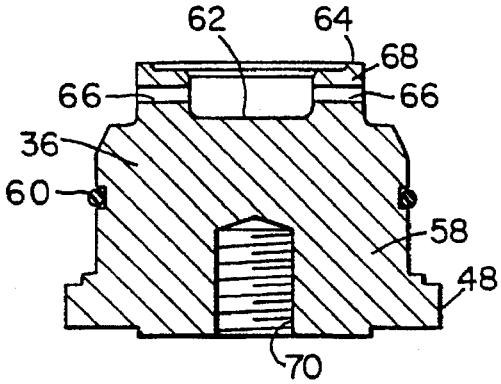
FIG. 5 is a longitudinal cross-sectional view of a closure plug for closing the outermost end of the valve compartment of the liquid manifold shown in FIGS. 2 through 4.

The structure of closure plug 36 is shown in cross section in FIG. 5. Plug 36 includes a plug body 58 that has an external seal ring 60 and is adapted to be received into the outer end portion of closure plug chamber 44 for closing and sealing plug chamber 44 to prevent the passage of liquid therethrough and to prevent liquid pressure from acting on the outer end of closure plug chamber 44. The innermost end of closure plug 36 includes a central recess 62, and a surrounding annular land 64 that includes a plurality of radially disposed flow passageways 66 that extend from recess 62 to annular outer surface 68 that has a smaller outer diameter than the plug diameter at 60, to form part of an annular discharge plenum chamber within valve chamber 42, as will hereinafter be described. Closure plug 36 also includes an internally threaded blind bore 70 at its outermost end for receiving a suitable plug removal tool (not shown) to facilitate removal of plug 36 from liquid manifold 16.

Figure 6:
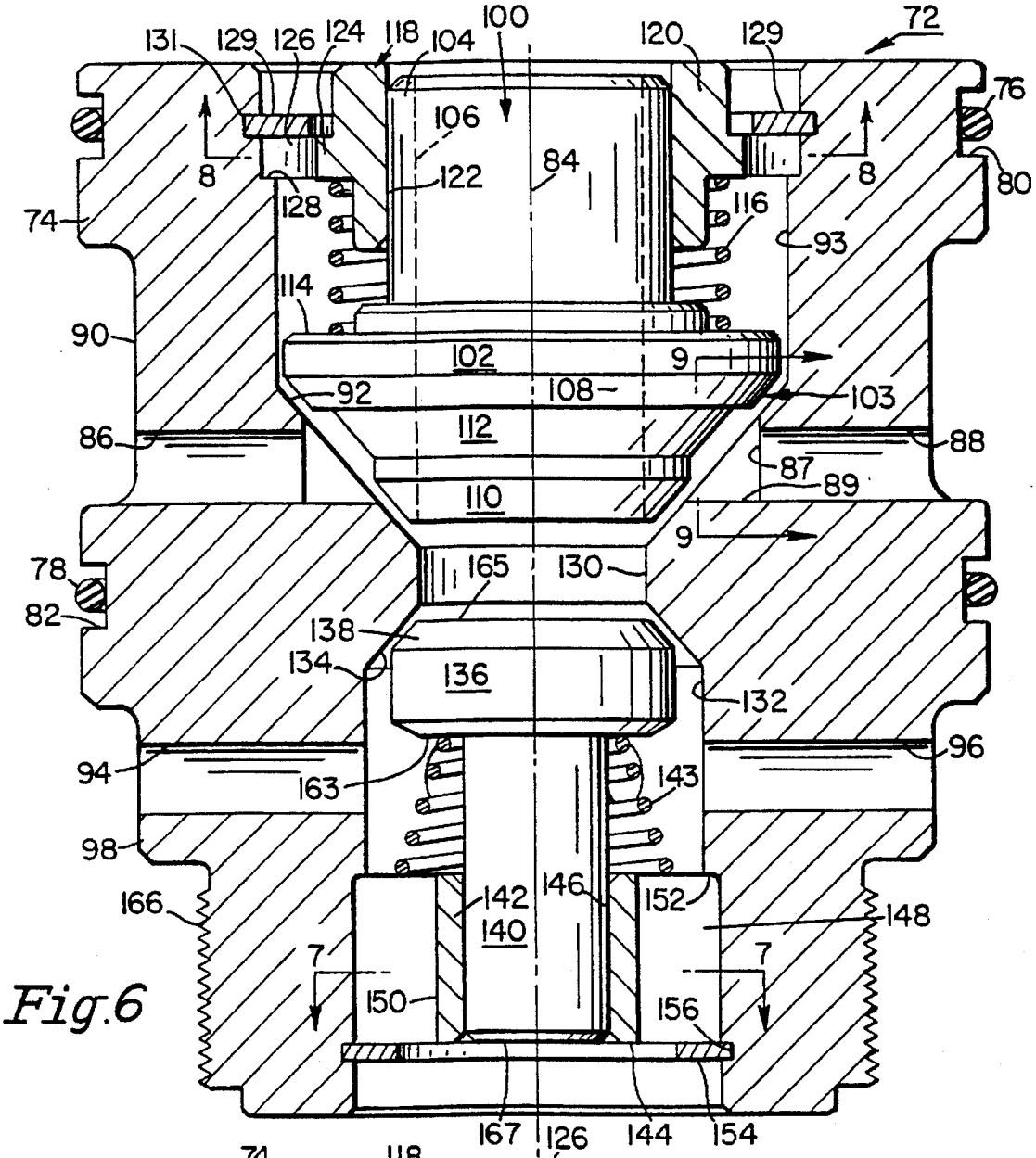
FIG. 6 is a longitudinal cross-sectional view taken through a cartridge valve in accordance with one aspect of the present invention.

One form of cartridge-type flow control valve in accordance with the present invention for controlling the flow of liquid to and from plunger cylinder 24 is shown in cross section in FIG. 6. Valve 72 includes a tubular valve housing 74 that carries a pair of externally disposed, axially spaced annular sealing rings 76, 78 that are received in annular sealing grooves 80, 82, respectively. Valve housing 74 has a central longitudinal axis 84, and includes a plurality of radially disposed inlet passageways shown in part as 86, 88 that extend from an outer, annular recessed surface 90 on the outermost surface of valve housing 74 to an inner, inclined suction valve seating surface 92 of frustoconical form that defines an inner wall of suction valve chamber 93. Similarly, a plurality of radially disposed outlet passageways shown in part as 94, 96 are provided in valve housing 74 at a position spaced axially from the position at which inlet passageways 86 and 88 are provided. An external, annular, recessed surface 98 is provided at the axial position corresponding with the outlets defined by the multiple discharge passageways shown in part as 94 and 96. Although as shown in FIG. 3 suction inlets 28 have their axes offset by 90° from the transverse axis on which the axes of outlets 30 and 54 lie, annular recessed surfaces 90 and 98 provide flow channels to permit communication between manifold inlet 28 and valve inlet passageways shown in part as 86 and 88, and between manifold outlets 30 and 54 and valve outlet passageways shown in part as 94 and 96, respectively.

Positioned within suction valve chamber 93 and between respective inlet passageways 86, 88 is a suction valve 100 that includes an annular suction valve body 102 from which extends an axially extending valve sleeve 104. Each of valve body 102 and valve sleeve 104 is of tubular form and includes a central throughbore 106. Valve body 102 includes an outer, frustoconical surface 103 that includes a pair of axially spaced, inclined annular sealing surfaces 108 and 110, and a recessed, annular pressure equalization groove 112 between sealing surfaces 108 and 110. Valve body 102 also includes a laterally extending bearing surface 114 against which one end of a helical compression spring 116 rests.

Figure 7:
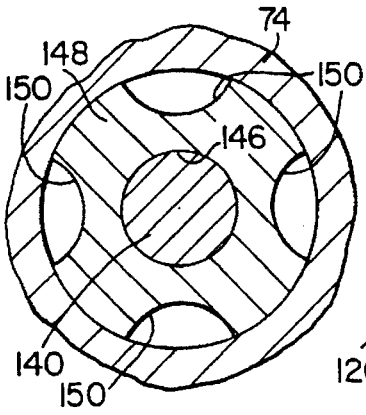
FIG. 7 is a fragmentary cross-sectional view taken along the line 7—7 of FIG. 6.
Figure 8:
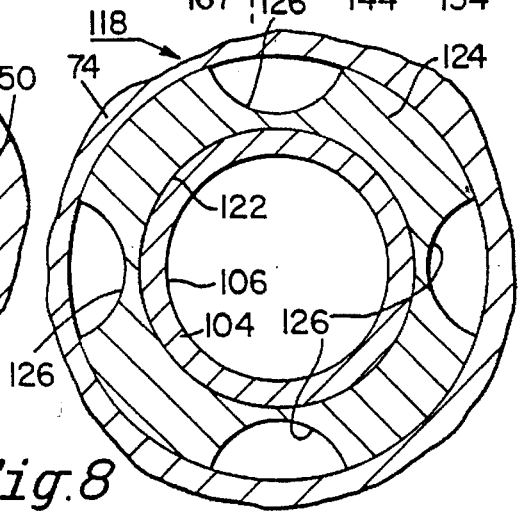
FIG. 8 is a fragmentary transverse cross-sectional view taken along the line 8—8 of FIG. 6.

A suction valve guide 118 is carried within valve housing 74 adjacent the outer portion of suction valve chamber 93 and at the end of housing 74 that faces plunger cylinder 24 within liquid manifold 16. Valve guide 118 includes a central tubular body 120 that has an inner bore 122 that slidably receives suction valve sleeve 104. Extending radially outwardly from tubular body 120 is an annular flange 124 (also see FIG. 7) that includes a plurality of peripheral recesses 126, preferably defined by circular arcs, to permit the passage therethrough of liquid between the interior of valve housing 74 and plunger cylinder 24 when valve 72 is positioned within liquid manifold 16. Annular flange 124 rests against inner annular shoulder 128 and is retained in position by a snap ring 129 that is received in annular slot 131 formed on the inner surface of the valve housing at a distance from shoulder 128 corresponding with the axial thickness of flange 124.

Positioned axially inwardly of suction valve chamber 93 is a relatively short axial connecting bore 130 that provides communication between suction valve chamber 93, plunger cylinder 24 and discharge valve chamber 132. Connecting bore 130 has a smaller diameter than the maximum diameter of either of suction valve chamber 93 or of discharge valve chamber 132. Forming a part of discharge valve chamber 132 is an inner, inclined discharge valve seating surface 134 of frustoconical form. As shown in FIG. 6, the axial length of inclined discharge valve seating surface 134 is substantially less than that of inclined suction valve seating surface 92. The remainder of discharge valve chamber 132 is of cylindrical form.

A discharge valve is received within discharge valve chamber 132 and includes a generally disc-shaped discharge valve member 136 having an annular, frustoconical sealing surface 138 adapted to engage with discharge valve seating surface 134 to block flow of liquid from axial bore 130 into discharge valve chamber 132. Extending axially into discharge valve chamber 132 from one transverse face of disk-shaped valve member 136 is a cylindrical discharge valve stem 140 that is slidably received in a discharge valve guide 142.

Discharge valve guide 142 is structurally similar to suction valve guide 118 in that it includes a tubular body portion 144 having an inner cylindrical surface 146 and having a radially outwardly extending annular flange 148 (also see FIG. 7) that includes a plurality of peripheral recesses 150, preferably defined by circular arcs, to permit the passage therethrough of high pressure liquid from the interior of discharge valve chamber 132 into recess 62 of closure plug 36 when valve 72 is positioned within liquid manifold 16. Annular flange 148 rests against inner annular shoulder 152 and discharge valve guide 142 is retained in position by a snap ring 154 that is received in an annular slot 156 formed on the inner surface of discharge valve chamber 132 at a distance from shoulder 152 corresponding with the axial thickness of flange 148.

Valve housing 74 also includes an externally threaded surface 166 for receiving a suitable valve removal tool (not shown) to facilitate removal of valve 72 from chambers 42 and 44.

Figure 9:
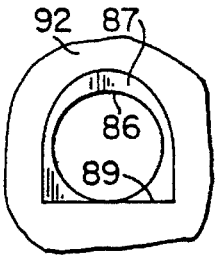
FIG. 9 is an end view of the fluid inlet passageway in the valve housing at the interior end thereof.

FIG. 9 shows the structural configuration at the innermost ends of each of multiple inlet passageways shown as 86 and 88. A relief or transition between passageway 86 and suction valve chamber 93 is provided by a counterbore 87 that has its axis transversely offset from the axis of passageway 86. A planar land 89 is provided in suction valve seating surface 92 substantially tangent to passageway 86 and extends transversely relative to valve housing axis 84. The illustrated structure results in an enlarged area transition chamber at the innermost end of the inlet passageway. As can be seen in FIG. 6, the transition chamber extends within the outermost axial edges of each of inclined annular sealing surfaces 108 and 110. This structure reduces or prevents metal fatigue at the intersection of suction holes (6) numbered 86 and 88 and surface 92.

Figure 10:
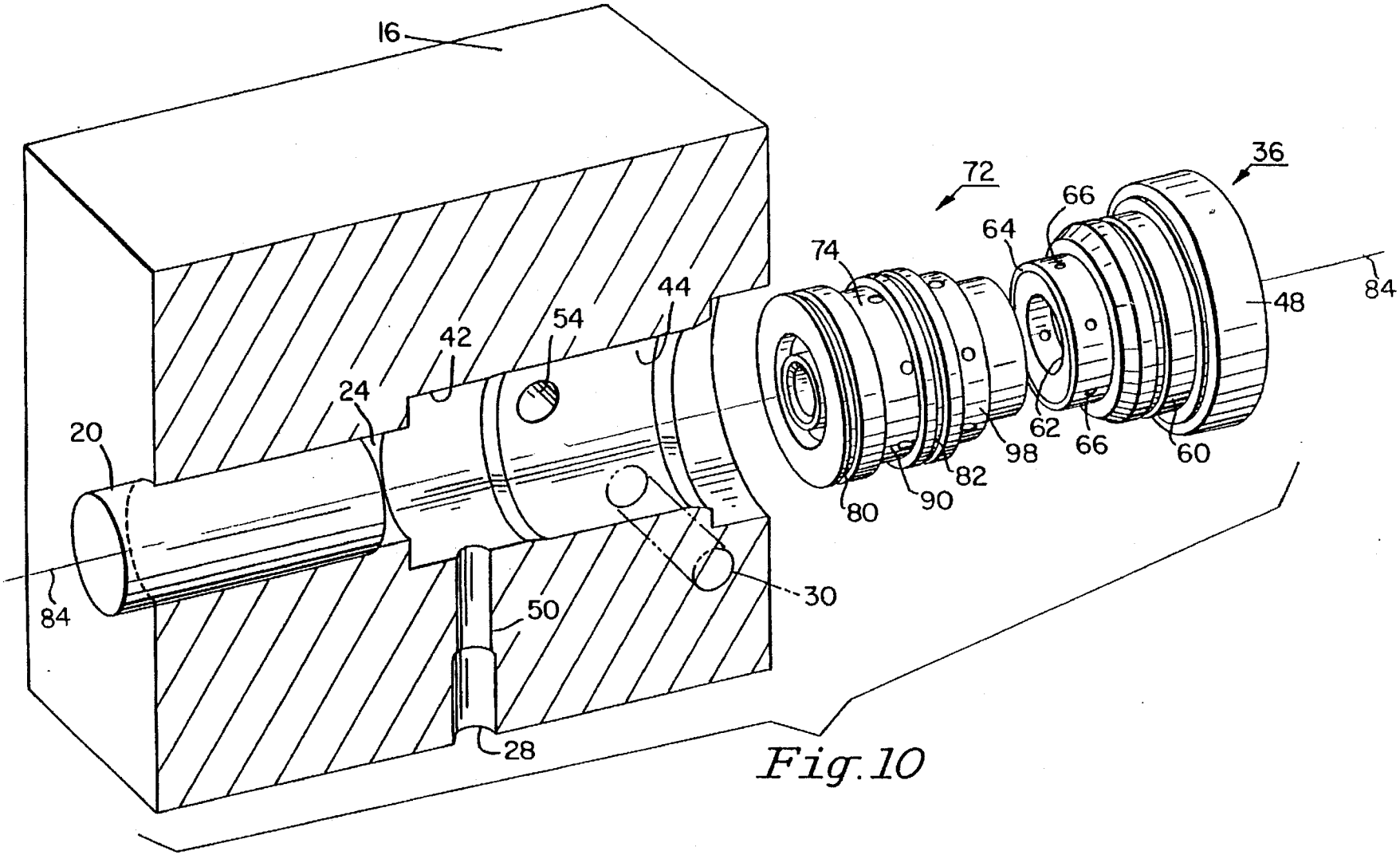
FIG. 10 is a sectional view, in perspective, through the axis of the valve chamber within the liquid manifold shown in FIGS. 2 through 4, and shows the valve and valve chamber closure plug in partially exploded form.
Figure 11:
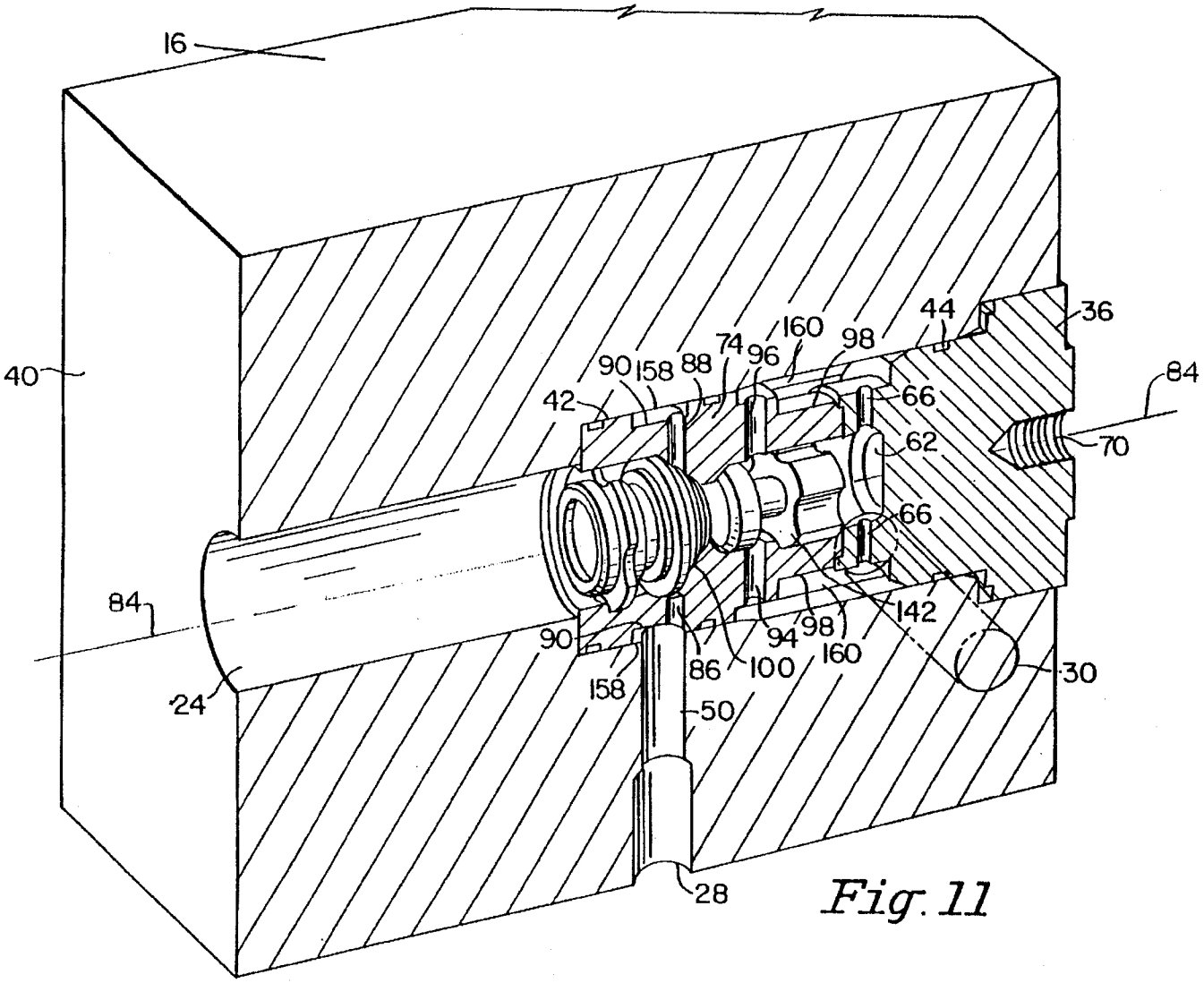
FIG. 11 is a view similar to that of FIG. 10, showing the internal structure of the valve body, and with the valve body and valve chamber closure plug in operative position within the manifold.

Referring now to FIG. 10, which is a cutaway view of liquid manifold 16 along the longitudinal axis of a plunger cylinder 24, there is shown plunger cylinder 24, cartridge valve chamber 42, and closure plug chamber 44, with valve housing 74 and closure plug 36 each separated from and spaced outwardly of manifold 16. FIG. 11 is another cutaway view, similar to that of FIG. 10, but with valve housing 74 and closure plug 36 in their operative position within manifold 16. As is apparent from FIGS. 10 and 11, the present invention permits easy and rapid access to the cartridge valve, permitting removal of the valve from the manifold merely by removing closure plug 36, and without the necessity for removing liquid manifold 16 from the pump drive housing, thereby considerably simplifying and reducing the time for flow control valve replacement.

Also apparent from FIG. 11 are the relative positions of an annular suction liquid plenum chamber 158 transversely opposite suction valve 100 and of an annular discharge liquid plenum chamber 160 transversely opposite discharge valve guide 142. Suction plenum chamber 158 is defined by annular recess 90 between valve housing 74 and the inner wall of manifold 16 defining cartridge valve chamber 42. Similarly, discharge plenum 160 is defined by the space between annular outer surface 98 and the inner wall of manifold 16 adjacent discharge passageways 54 and 30.

An alternative embodiment 161 for the cartridge valve structure is shown in FIGS. 12 through 15. In general, the valve structure and orientation shown in FIGS. 12 through 15 are similar to those of the valve embodiment shown in FIGS. 6 through 9. The principal differences between the two embodiments reside in the support arrangement for supporting and guiding the movement of the suction valve within the valve housing, and the support arrangement for supporting and guiding the discharge valve within the valve housing.

Figure 12:
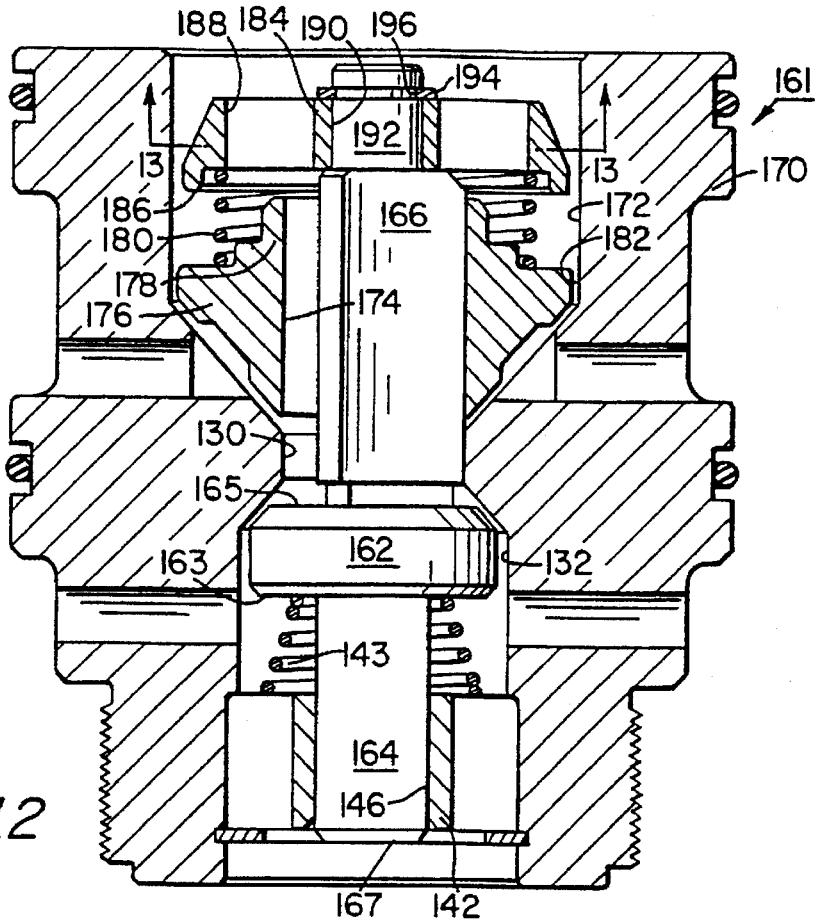
FIG. 12 is a longitudinal cross-sectional view of another embodiment of a cartridge valve in accordance with the present invention.
Figure 13:
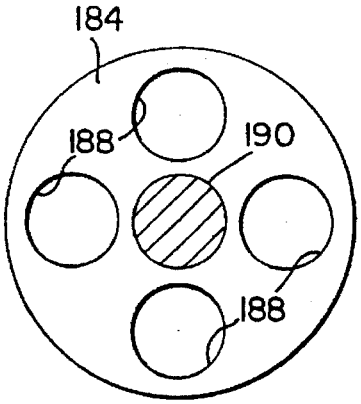
FIG. 13 is an end view of a valve guide forming part of the suction valve structure for the cartridge valve shown in FIG. 12.

Referring to FIG. 12, a disc-shaped discharge valve 162 includes first, a cylindrical discharge valve stem 164 that extends axially from transverse surface 163 of discharge valve 162, and a second, elongated suction valve guide portion 166 that extends axially from the opposite transverse side 165 of discharge valve 162. Discharge valve stem 164 is slidably received for axial movement along inner cylindrical surface 146 of discharge valve stem guide 142, which has the same structure and function as the corresponding guide structure in the embodiment illustrated in FIGS. 6 through 9.

Suction valve guide portion 166, which takes the place of suction valve guide 118 in the embodiment illustrated in FIGS. 6 through 9, extends axially through central axial bore 130 within valve housing 170, into suction valve chamber 172, and is received within a central bore 174 of suction valve 176. A suction valve sleeve 178 extends axially from suction valve 176, but has a shorter axial length than suction valve sleeve 104 of the valve embodiment illustrated in FIGS. 6 through 9. In all other respects, suction valve 176 has the same structure as suction valve 100 in the valve embodiment illustrated in FIG. 11.

Suction valve 176 is urged into the closed condition by helical compression spring 180 that has a first end that bears against transversely extending shoulder 182 of suction valve 176, and a second end that bears against and is retained by substantially disk-shaped suction valve spring retainer 184. An axially extending lip 186 on spring retainer 184 limits lateral movement of the end of helical spring 180. Additionally, spring retainer 184 includes a plurality of spaced, axially extending throughbores 188 (also see FIG. 13) to permit the passage therethrough of liquid between suction valve chamber 172 and plunger cylinder 24 when valve housing 170 is positioned within liquid manifold 16. Retainer 184 also includes a central bore 190 to receive a correspondingly sized cylindrical stub end 192 of guide portion 166. A snap ring 194 is received in an annular slot 196 provided in stub end 192 to limit outward axial movement of spring retainer 184 relative to discharge valve 162.

Figure 14:
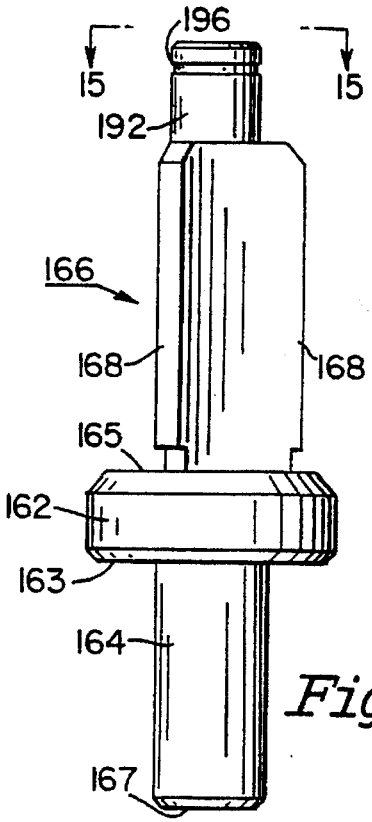
FIG. 14 is an elevational view of the discharge valve forming part of the cartridge valve structure shown in FIG. 12.
Figure 15:
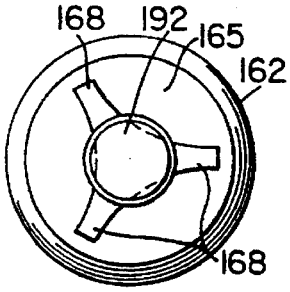
FIG. 15 is a top end view of the discharge valve structure shown in FIG. 14.

As best seen in FIGS. 14 and 15, suction valve guide portion 166 includes three axially elongated, equally angularly spaced and radially extending guide arms 168. The space between adjacent guide arms 168 is provided to allow high-pressure liquid to flow from plunger cylinder 24 within liquid manifold 16 to discharge valve chamber 132. The radial length of the several guide arms 168 corresponds substantially with the radius of central bore 174 so that suction valve 176 can freely slide axially along the outermost edges of each of guide arms 168.

Figure 16:
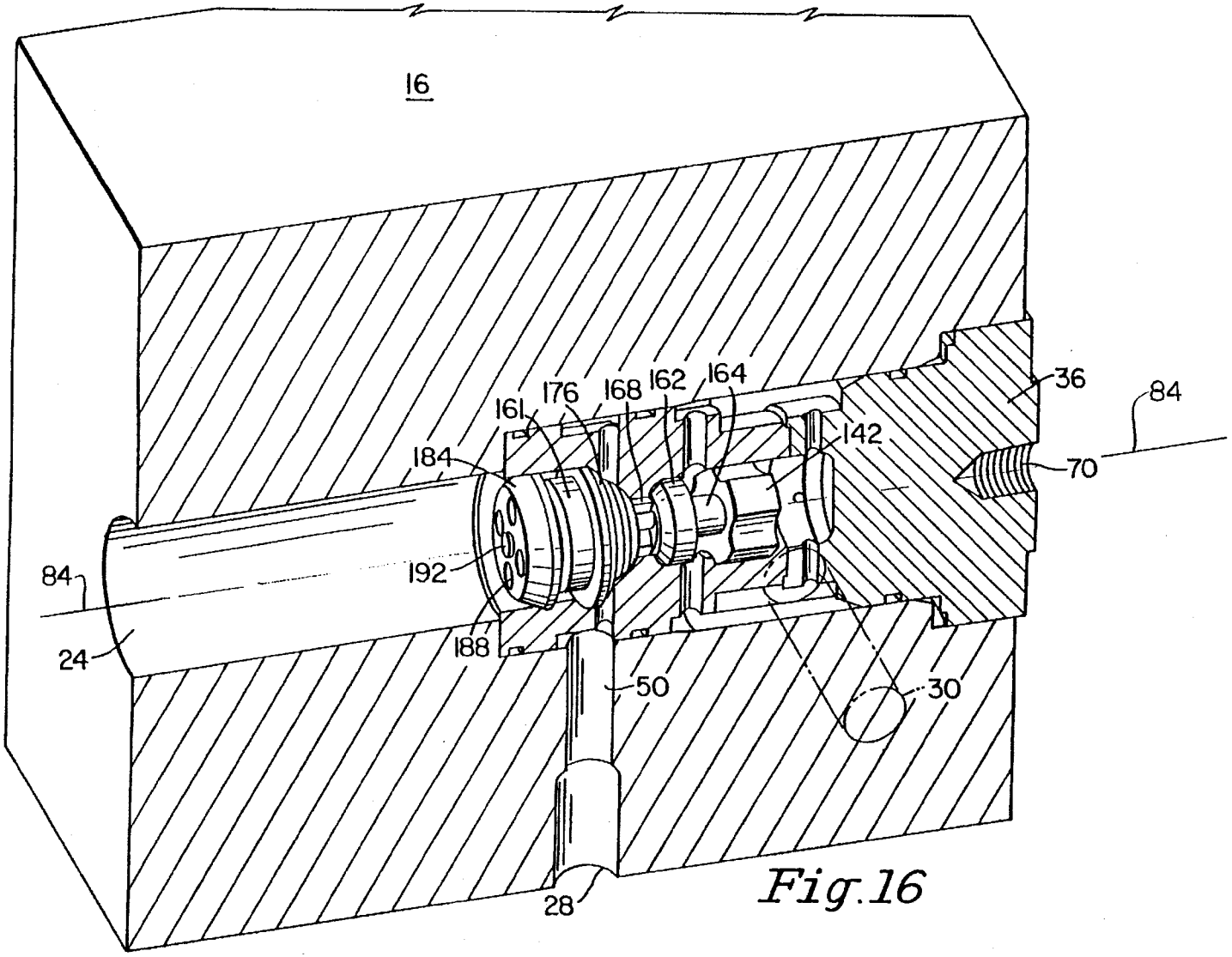
FIG. 16 is a view similar to that of FIG. 11, showing the alternative valve embodiment in position within the liquid manifold.

FIG. 16 shows the alternative cartridge valve embodiment 161 in operative position within liquid manifold 16. As illustrated in FIG. 16, the housing of valve 161 is shown in perspective in longitudinal section, while the remaining valve elements are shown in full perspective.

In operation, and referring to the structural elements illustrated in FIGS. 1 through 11, crankshaft 18 of pump 10 is rotated by an external power source (not shown) to cause each of plungers 20 to reciprocate within their respective plunger cylinders 24.

On the withdrawal stroke of a plunger 20, as the plunger moves in a direction away from fluid manifold 16, the pressure within plunger cylinder 24 decreases resulting in an unbalanced force acting on suction valve 100. The unbalanced force results from the larger force imposed on valve 100 by the inlet liquid that is to be pressurized, which flows through suction port 28, into suction passageway 50, and then into suction plenum chamber 158. The liquid exerts on the frustoconical surface of annular pressure equalization groove 112 a force greater than the combined forces acting on bearing surface 114 and on the outer transverse end of sleeve 104 to provide an unbalanced force that urges suction valve 100 to move axially away from its seat within the valve body and against the opposing force of suction valve spring 116. Low pressure inlet liquid flows through suction valve chamber 93, as well as into axial bore 130, the bore contained within surface 106, and into plunger cylinder 24 to fill plunger cylinder 24 as plunger 20 retracts.

When plunger 20 has reached the limit of its withdrawal or suction stroke it then changes direction and moves axially outwardly into liquid manifold 16. As plunger 20 moves outwardly it displaces the liquid, raising the pressure in plunger cylinder 24 until it is equal to the pressure of the liquid in suction inlet 28. At this point spring 116 urges suction valve 103 toward its seat in valve housing 74. Once suction valve 100 is closed and plunger 20 continues to displace the liquid, the increasing pressure acts against bearing surface 114 and against the outer transverse end of sleeve 104 to tighten the closure of valve surfaces 108 and 110 against seating surface 92 thereby closing each of the inlet passageways shown as 86 and 88.

Continued movement of plunger 20 toward valve 72 further increases the pressure of the liquid within plunger cylinder 24. When the liquid which is contained within suction valve chamber 93 and within the volume defined by axial bore 130 reaches a pressure which will apply a force to high pressure valve face 165 sufficient to overcome the force exerted by the fluid pressure in cavity 62 and discharge valve chamber 132 acting against surfaces 163 and 167 plus the force of spring 143 high pressure valve 136 will be urged away from its seating surface 134. Pressurized liquid from plunger cylinder 24 will then flow into discharge valve chamber 132, through multiple passageways shown as 96 and 98 into discharge plenum chamber 160 thence into liquid outlets 30 and 54 in liquid manifold 16.

As plunger 20 commences its inward movement the pressure within the volume defined by axial bore 130 and suction valve chamber 93 becomes equal to the pressure in discharge plenum chamber 160. At this time high pressure valve 136 will be urged closed by spring 143 with sealing surface 138 fitting against valve seating surface 134.

As plunger 20 continues its inward movement the pressure in plunger cylinder 24 will decrease until the force exerted by the suction water pressure against the annular pressure equalization groove 112 is sufficient to lift the valve against the force exerted by spring 116 and the remaining plunger cylinder pressure acting against bearing surface 114 and the end of valve sleeve 104. Fluid will now flow into suction valve chamber 93, the volume defined by axial bore 130, central throughbore 106 and plunger cylinder 24. Fluid will continue to fill these cavities until plunger 20 reaches its full inward position.

When plunger 20 has reached the limit of its inward withdrawal or suction stroke it then changes direction and moves axially outward and into liquid manifold 16 thus completing the cycle. The cycle is repeated with each rotation of crankshaft 18.

The cartridge valve embodiment having the structure illustrated in FIGS. 12 through 16 operates in a similar manner. However, that valve structure provides the advantage of more rapid suction valve movement, in part because of the lighter weight of that element by virtue of the shorter axial length and consequent smaller size of suction valve sleeve 178 shown in FIG. 12 as compared with suction valve sleeve 104 as shown in FIG. 6. Another factor causing the more rapid closing of suction valve 176 of FIG. 12 as compared with that of suction valve 102 of FIG. 6 is the additional spring force acting on surface 182 of suction valve 176 because of the movement of spring retainer 184 toward suction valve 176 as discharge valve 162 is caused to open and to move away from suction valve 176.

The valve structures herein described have been found to provide significantly increased service life as compared with the prior art devices. In tests at discharge pressures ranging from 10,000 to about 15,000 psi., plunger pumps having the manifold structure and valve structures of the first embodiment herein described underwent over 10 million stress cycles without failure, aggregating over 5,000 pump operating hours at a crankshaft rotation speed of approximately 83 rpm. Among the reasons for the extended service life of the valves and liquid manifold having the structure herein disclosed is the fact that the wide range of liquid pressure fluctuations are retained within the replaceable cartridge valve and in the plunger chamber, and they do not act against the valve chamber wall or the cross-port area as included in and as part of the prior art high pressure liquid pump arrangements.

The low-pressure or suction valve of the present valve structure invention can be characterized as a balanced design. That design permits the low pressure or suction valve to open and to admit liquid at low positive suction pressure as soon as the high-pressure valve begins to seat, thereby avoiding cavitation and maximizing pump efficiency.

Additionally, the high-pressure valve has a narrow seating area and a smaller projected area to minimize the liquid pressure required to open it against the system back pressure. That construction contributes to early opening and closing of the high-pressure valve during each pumping stroke, thereby additionally improving volumetric efficiency, and also improving valve operating life by reducing the effect of pressure and flow pulsations in the discharge liquid, and consequent reduction in fatigue loading of the valve body and internal parts. The intensified pressures at which the present valves are capable of sustained operation, and the accompanying pressure fluctuations, are contained within the plunger chamber and within the replaceable cartridge. Consequently, valve wear is limited to the valve body and valve seat contact areas, and easy replaceability and correction for any such wear can be readily accomplished.

The long, cylindrical shape of the valves in accordance with the present invention, as opposed to a shorter, flatter design, permits effective spring design so that the suction and discharge valves will not have metal-to-metal contact upon opening, thus further prolonging valve operating life. The long, cylindrical shape also permits design of the hydraulic valve manifold block with minimal internal stresses, as compared with shorter, larger diameter valves, which require larger manifold bores, thereby increasing the internal stresses within the manifold and limiting the volumetric capability of the pump.

The valve structures in accordance with the present invention provide for linear flow of the pressurized liquid through the valve structure, which thereby reduces erosive wear caused by cavitation that can occur when high pressure fluids flow past sharp corners.

The alternative valve embodiment provides increased volumetric efficiency in that the high pressure discharge valve more rapidly attains full face seating, immediately upon flow reversal within the valve housing as the plunger direction changes from movement into the plunger cylinder to retraction from the plunger cylinder. Additionally, the high pressure discharge valve is double guided, in that it includes guide means at each end thereof, and assembly and disassembly of the valve are simpler.

Finally, it has been found that improved long term performance can be enhanced by replacing the more commonly used nickel plated carbon steel manifold with one made from Carpenter custom 450 stainless steel that has been heat treated to condition H1050, 37 Rockwell C hardness, yield strength of 152,000 psi., and tensile strength of 160,000 psi. Advantageously, the valve seats are also made from that material. With regard to the discharge and suction valves, and also the discharge and suction valve guides, the preferred material is AISI type 440 C stainless steel, quenched and tempered at 500° F. to obtain a Rockwell C hardness of 57, a yield strength of 275,000 psi., and a tensile strength of 285,000 psi.

It is therefore apparent that the valve, manifold, and pump structures herein disclosed provide distinct advantages over the prior art devices, particularly the significantly improved operating life.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. A high-pressure pump having at least one pump cylinder including a reciprocating plunger for increasing the pressure of a liquid to pressures of the order of up to about 15,000 psi. and at flows of up to at least about 20 to 30 gpm. for a single pump cylinder, said pump comprising:

a) a pump drive housing including at least one plunger extending outwardly of the drive housing and supported for reciprocating movement along a plunger movement axis, and drive means within the pump drive housing and operatively connected with the at least one plunger for converting continuous rotational input power into linear, reciprocating movement of the at least one plunger;

b) a liquid manifold overlying and at least partially enclosing the at least one plunger and adapted to be connected with the drive housing, the manifold including a plunger cylinder coaxial with the at least one plunger for receiving and supporting the at least one plunger as the at least one plunger reciprocates within the cylinder to increase the pressure of liquid contained within the cylinder, the manifold including a valve chamber having a longitudinal axis and coaxial with and in communication with the plunger cylinder and including suction and discharge passageways extending from the valve chamber to outer surfaces of the manifold for conveying liquids to and from the valve chamber and a valve removal opening on a side of the manifold opposite from the plunger cylinder and coaxial therewith, the valve removal opening providing communication between the valve chamber and an outer surface of the manifold for permitting insertion and removal of a valve into and out of the valve chamber without separating the manifold from the pump drive housing; and c) a cartridge-type valve removably carried in the valve chamber to control liquid flow into and out of the plunger cylinder, the cartridge-type valve defining within the valve chamber a suction valve chamber for receiving fluid to be pressurized, and including at least one passageway for providing fluid communication between the suction valve chamber and the suction passageway in the liquid manifold, and a suction valve for controlling flow of low-pressure liquid into the plunger cylinder and a discharge valve for controlling flow of high-pressure liquid from the plunger cylinder, the manifold suction passageway providing communication via the at least one passageway between an inlet opening in the manifold and the suction valve for admitting into the cartridge-type valve liquid to be pressurized, the suction valve being movable into a position blocking fluid communication between the at least one passageway and the suction valve chamber and the manifold discharge passageway providing communication between the discharge valve and an outlet opening in the manifold for conducting pressurized liquid from the cartridge-type valve to the outlet opening in the manifold.

2. A pump in accordance with claim 1 wherein the fluid manifold includes a closure member adapted to be removably received in the valve removal opening for closing the valve removal opening and sealing the valve chamber from the surrounding atmosphere, a sealing ring cooperating with said closure member for sealing high pressure fluid in the plunger cylinder whereby stresses induced by the high pressure fluid in a direction toward said manifold front surface are minimal thereby contributing to long service life of said manifold.

3. A pump in accordance with claim 1 wherein the suction passageway and the discharge passageway are angularly offset from each other relative to the valve chamber longitudinal axis.

4. A pump in accordance with claim 3 wherein the angular offset is about 90°.

5. A pump in accordance with claim 3 wherein the valve chamber includes a first cylindrical suction liquid section in communication with the suction passageway and defined by a first diameter, and a second cylindrical discharge liquid section in communication with the discharge passageway and defined by a second diameter different from the first diameter.

6. A pump in accordance with claim 5 wherein the second diameter is greater than the first diameter.

7. A pump in accordance with claim 1 wherein the cartridge-type valve includes;

a. a tubular valve housing having a longitudinal axis and including a suction valve chamber for axially removably receiving a suction valve body, a discharge valve chamber spaced from the suction valve chamber for axially removably receiving a discharge valve body, the housing including a suction inlet passageway extending transversely through the housing to a first axial position relative to the housing axis, a discharge outlet passageway extending transversely through the housing to a second axial position relative to the housing axis, wherein the second position is axially spaced along the housing longitudinal axis from the first position, a suction valve seat positioned within the valve housing, and a discharge valve seat positioned within the valve housing and spaced along the housing longitudinal axis from the suction valve seat;

b. a suction valve axially slidably received within the valve housing for movement toward and away from the suction valve seat; and c. a discharge valve axially slidably received within the valve housing for movement toward and away from the discharge valve seat and spaced axially from the suction valve.

8. A pump in accordance with claim 7 including suction valve guide means positioned within the suction valve housing for axially guiding movement of the suction valve as it moves toward and away from the suction valve seat.

9. A pump in accordance with claim 8 wherein the valve housing includes an interconnecting bore coaxial with the housing longitudinal axis and interconnecting the suction valve chamber and the discharge valve chamber, and wherein the suction valve guide means includes an axial guide member carried by the discharge valve body and extending through the intermediate connecting bore and into the suction valve chamber.

10. A fluid manifold for a high-pressure plunger pump adapted to provide liquid at pressures of at least about 10,000 to 15,000 p.s.i., said manifold comprising a unitary housing including a cylindrical plunger cylinder within the housing for slidably receiving a reciprocating plunger for pressurizing a liquid introduced into the plunger cylinder, a flow control valve chamber within the housing and coaxial with and in communication with the plunger cylinder, the flow control valve chamber having a longitudinal axis and a cross-sectional area greater than that of the plunger cylinder for receiving and supporting a cartridge-type flow control valve having in-line suction and discharge valves, the flow control valve chamber extending from the plunger chamber to a valve removal opening in an outer surface of the manifold spaced from and opposite from the plunger chamber to permit the flow control valve to be removed from the manifold through the valve removal opening while the manifold is secured to a pump drive housing, a suction passageway extending transversely relative to the longitudinal axis of the valve chamber and extending between the valve chamber and a low-pressure-liquid inlet opening at an outer surface of the manifold for providing communication between a source of low pressure liquid external to the manifold and the valve chamber, and a discharge passageway spaced axially along the valve chamber longitudinal axis from the suction passageway and extending transversely relative to the longitudinal axis of the valve chamber to provide communication between a high-pressure-liquid outlet in the manifold and the valve chamber, the portion of the valve chamber containing the suction passageway having a smaller diameter than the portion of the valve chamber containing the discharge passageway.

11. A fluid manifold in accordance with claim 10 including a closure member adapted to be removably received in the valve removal opening for closing the valve removal opening and sealing the valve chamber from the surrounding atmosphere.

12. A fluid manifold in accordance with claim 11 wherein the valve removal opening communicates with an inner bore that slidably receives the closure member and the cartridge valve.

13. A fluid manifold in accordance with claim 10 wherein the suction passageway and the discharge passageway are angularly offset from each other relative to the valve chamber longitudinal axis.

14. A fluid manifold in accordance with claim 12 wherein the angular offset is about 90°.

15. A fluid manifold in accordance with claim 12 wherein the valve chamber includes a first cylindrical suction liquid section in communication with the suction passageway and defined by a first diameter, and a second cylindrical discharge liquid section in communication with the discharge passageway and defined by a second diameter different from the first diameter.

16. A fluid manifold in accordance with claim 14 wherein the second diameter is greater than the first diameter.

17. A cartridge-type valve for controlling the flow of low pressure inlet liquid and high-pressure outlet liquid to and from a plunger cylinder of a high-pressure liquid pump, said valve comprising:

a. a tubular valve housing having a longitudinal axis and including a suction valve chamber for axially removably receiving a suction valve body, a discharge valve chamber spaced from the suction valve chamber for axially removably receiving a discharge valve body, the valve housing including a suction inlet passageway extending transversely through the valve housing to a first axial position relative to the valve housing longitudinal axis, a discharge outlet passageway extending transversely through the valve housing to a second axial position relative to the valve housing longitudinal axis, wherein the second axial position is axially spaced along the valve housing longitudinal axis from the first axial position, a suction valve seating surface positioned within the valve housing, and a discharge valve seating surface positioned within the valve housing and spaced axially along the valve housing longitudinal axis from the suction valve seat;

b. a suction valve axially slidably received within the valve housing for movement toward and away from the suction valve seating surface; and c. a discharge valve axially slidably received within the valve housing for movement toward and away from the discharge valve seating surface and spaced axially from the suction valve, wherein the suction valve body includes a frustoconical sealing surface engageable with the suction valve seating surface for preventing flow of fluid into the valve housing, and wherein the sealing surface is defined by a pair of axially spaced, inclined annular sealing surfaces.

18. A valve in accordance with claim 17 wherein the suction valve body includes a central axial bore for permitting liquid to flow axially through the suction valve body.

19. A valve in accordance with claim 17 wherein the suction valve chamber has a diameter greater than that of the discharge valve chamber.

20. A valve in accordance with claim 17 wherein the discharge valve chamber has a smaller diameter than that of the suction valve chamber.

21. A valve in accordance with claim 17 including an interconnecting bore coaxial with the valve housing longitudinal axis and interconnecting the suction valve chamber and the discharge valve chamber.

22. A valve in accordance with claim 17 wherein the valve housing includes a first peripheral external recess in communication with the suction inlet passageway to define an external annular suction liquid plenum chamber.

23. A valve in accordance with claim 22 including annular sealing means positioned on each side of the first peripheral external recess.

24. A valve in accordance with claim 22 wherein the valve housing includes a second peripheral external recess in communication with the discharge outlet passageway to define an external annular discharge liquid plenum chamber.

25. A valve in accordance with claim 17 wherein the suction valve body includes a central axial throughbore having its axis coincident with the valve housing longitudinal axis.

26. A valve in accordance with claim 25 including an interconnecting bore coaxial with the valve housing longitudinal axis and interconnecting the suction valve chamber and the discharge valve chamber, and wherein the suction valve throughbore has a diameter substantially equal to the diameter of the interconnecting bore within the valve housing.

27. A valve in accordance with claim 17 including suction valve guide means positioned within the suction valve chamber for axially guiding movement of the suction valve body as it moves toward and away from the suction valve seating surface.

28. A valve in accordance with claim 27 including spring biasing means extending between the suction valve guide means and the suction valve body for resiliently urging the suction valve body into sealing engagement with the suction valve seating surface.

29. A valve in accordance with claim 27 wherein the suction valve guide means includes a tubular guide sleeve positioned coaxially within the suction valve chamber, and the suction valve body includes a tubular collar slidably received within the tubular guide sleeve.

30. A valve in accordance with claim 27 wherein the suction valve guide means includes a positioning flange extending transversely within the valve housing for contact with the valve housing, and a plurality of flow apertures extending through the flange to permit liquid flow therethrough.

31. A valve in accordance with claim 17 wherein the discharge valve includes a frustoconical sealing surface engageable with the discharge valve seating surfaces for preventing flow of liquid from the suction valve housing to the discharge passageway.

32. A valve in accordance with claim 17 including discharge valve guide means positioned within the discharge valve chamber for axially guiding movement of the discharge valve body as it moves toward and away from the discharge valve seat.

33. A valve in accordance with claim 32 including spring biasing means extending between the discharge valve guide means and the discharge valve body for resiliently urging the discharge valve body into sealing engagement with the discharge valve seating surface.

34. A valve in accordance with claim 32 wherein the discharge valve guide means includes a tubular guide sleeve positioned coaxially within the discharge valve chamber, and the discharge valve body includes a cylindrical extension that is slidably received within the tubular guide sleeve.

35. A valve in accordance with claim 32 wherein the discharge valve guide means includes a positioning flange extending transversely within the valve housing for contact with the valve housing, and a plurality of flow apertures extending through the positioning flange to permit liquid flow therethrough.

36. A valve in accordance with claim 27 including an interconnecting bore coaxial with the valve housing longitudinal axis and interconnecting the suction valve chamber and the discharge valve chamber, wherein the suction valve guide means includes an axial guide member carried by the discharge valve and extending through the interconnecting bore and into the suction valve chamber.

37. A valve in accordance with claim 36 wherein the suction valve body includes an axial throughbore defining an inner annular surface, and the axial guide member includes a plurality of elongated, circumferentially spaced, radially extending arms for freely slidably contacting the inner annular surface of the suction valve body for guiding axial movement of the suction valve body relative to the valve housing axis.

38. A valve in accordance with claim 36 wherein the axial guide member includes a spring retainer for retaining a suction valve spring between the spring retainer and the suction valve body.

39. A valve in accordance with claim 38 wherein the spring retainer includes a plurality of axially extending through-bores to permit axial flow of liquid therethrough.

40. A cartridge-type valve for controlling the flow of low pressure inlet liquid and high-pressure outlet liquid to and from a plunger cylinder of a high-pressure liquid pump, said valve comprising:

a. a tubular valve housing having a longitudinal axis and including a suction valve chamber for axially removably receiving a suction valve body, a discharge valve chamber spaced from the suction valve chamber for axially removably receiving a discharge valve body, the valve housing including a suction inlet passageway extending transversely through the valve housing to a first axial position relative to the valve housing longitudinal axis, a discharge outlet passageway extending transversely through the valve housing to a second axial position relative to the valve housing longitudinal axis, wherein the second axial position is axially spaced along the valve housing longitudinal axis from the first axial position, a suction valve seating surface positioned within the valve housing, and a discharge valve seating surface positioned within the valve housing and spaced axially along the valve housing longitudinal axis from the suction valve seat;

b. a suction valve axially slidably received within the valve housing for movement toward and away from the suction valve seating surface; and c. a discharge valve axially slidably received within the valve housing for movement toward and away from the discharge valve seating surface and spaced axially from the suction valve, wherein the suction valve body includes a central axial throughbore having its axis coincident with the valve housing longitudinal axis and includes an interconnecting bore coaxial with the valve housing longitudinal axis and interconnecting the suction valve chamber and the discharge valve chamber, and wherein the suction valve throughbore has a diameter substantially equal to the diameter of the interconnecting bore within the valve housing.

41. A valve in accordance with claim 40 wherein the valve housing includes an inner, suction valve chamber having an inner, inclined annular suction valve seating surface.

42. A valve in accordance with claim 41 wherein the suction inlet passageway opens to and intersects with the suction valve seating surface.

43. A valve in accordance with claim 40 wherein the valve housing includes an inner, discharge valve chamber including an inner, inclined annular discharge valve seating surface.

44. A valve in accordance with claim 43 wherein the discharge outlet passageway is spaced axially along the valve housing axis from the discharge valve seating surface.

45. A valve in accordance with claim 40 wherein the suction valve body includes a frustoconical sealing surface engageable with the suction valve seating surface for preventing flow of fluid into the valve housing.

46. A valve in accordance with claim 45 wherein the sealing surface is defined by a pair of axially spaced, inclined annular sealing surfaces.

47. A valve in accordance with claim 46 wherein the sealing surface includes a recessed annular groove between the sealing surfaces.

48. A cartridge-type valve for controlling the flow of low pressure inlet liquid and high-pressure outlet liquid to and from a plunger cylinder of a high-pressure liquid pump, said valve comprising:

a. a tubular valve housing having a longitudinal axis and including a suction valve chamber for axially removably receiving a suction valve body, a discharge valve chamber spaced from the suction valve chamber for axially removably receiving a discharge valve body, the valve housing including a suction inlet passageway extending transversely through the valve housing to a first axial position relative to the valve housing longitudinal axis, a discharge outlet passageway extending transversely through the valve housing to a second axial position relative to the valve housing longitudinal axis, wherein the second axial position is axially spaced along the valve housing longitudinal axis from the first axial position, a suction valve seating surface positioned within the valve housing, and a discharge valve seating surface positioned within the valve housing and spaced axially along the valve housing longitudinal axis from the suction valve seat;

b. a suction valve axially slidably received within the valve housing for movement toward and away from the suction valve seating surface; and c. a discharge valve axially slidably received within the valve housing for movement toward and away from the discharge valve seating surface and spaced axially from the suction valve, said cartridge-type valve including suction valve guide means positioned within the suction valve chamber for axially guiding movement of the suction valve body as it moves toward and away from the suction valve seating surface, and wherein the suction valve guide means includes a positioning flange extending transversely within the valve housing for contact with the valve housing, and a plurality of flow apertures extending through the flange to permit liquid flow therethrough.

49. A valve in accordance with claim 48 wherein the valve housing includes an inner, suction valve chamber having an inner, inclined annular suction valve seating surface, and wherein the valve housing includes an inner, discharge valve chamber including an inner, inclined annular discharge valve seating surface.

50. A valve in accordance with claim 49 wherein the suction valve seating surface and the discharge valve seating surface are each inclined inwardly relative to the housing axis.

51. A cartridge-type valve for controlling the flow of low pressure inlet liquid and high-pressure outlet liquid to and from a plunger cylinder of a high-pressure liquid pump, said valve comprising:

a. a tubular valve housing having a longitudinal axis and including a suction valve chamber for axially removably receiving a suction valve body, a discharge valve chamber spaced from the suction valve chamber for axially removably receiving a discharge valve body, the valve housing including a suction inlet passageway extending transversely through the valve housing to a first axial position relative to the valve housing longitudinal axis, a discharge outlet passageway extending transversely through the valve housing to a second axial position relative to the valve housing longitudinal axis, wherein the second axial position is axially spaced along the valve housing longitudinal axis from the first axial position, a suction valve seating surface positioned within the valve housing, and a discharge valve seating surface positioned within the valve housing and spaced axially along the valve housing longitudinal axis from the suction valve seat;

b. a suction valve axially slidably received within the valve housing for movement toward and away from the suction valve seating surface; and c. a discharge valve axially slidably received within the valve housing for movement toward and away from the discharge valve seating surface and spaced axially from the suction valve,, said cartridge-type valve including discharge valve guide means positioned within the discharge valve chamber for axially guiding movement of the discharge valve body as it moves toward and away from the discharge valve seat, wherein the discharge valve guide means includes a positioning flange extending transversely within the valve housing for contact with the valve housing, and a plurality of flow apertures extending through the positioning flange to permit liquid flow therethrough.

* * * * *